US005818392A

United States Patent [19]

Oka et al.

[11] Patent Number: 5,818,392

[45] Date of Patent: Oct. 6, 1998

[54] ANTENNA WITH FIXED AND MOVABLE ELEMENTS

[75] Inventors: Shinji Oka; Eiichi Nakanishi; Tetsuo Onodera; Hiroshi Shimizu, all of Tokyo, Japan

[73] Assignee: Oki Electric Industry Co., Ltd., Tokyo, Japan

[21] Appl. No.: 557,808

[22] Filed: Nov. 14, 1995

[30] Foreign Application Priority Data

Nov. 25, 1994 [JP] Japan ..... 6-291404

[51] Int. Cl.[6] ..... H01Q 1/24

[52] U.S. Cl. ..... 343/702; 343/895

[58] Field of Search ..... 343/702, 841, 343/906, 895, 713, 715, 876; 455/89, 90; H01Q 1/24

[56] References Cited

U.S. PATENT DOCUMENTS 4,862,182 8/1989 Egashira ..... 343/702
5,317,325 5/1994 Bottomley ..... 343/895
5,446,469 8/1995 Makino ..... 343/702
5,479,178 12/1995 Ha ..... 343/702

*Primary Examiner*—Hoanganh T. Le
*Attorney, Agent, or Firm*—Robin, Champagne, & Lynt, P.C.

[57] ABSTRACT

In a mobile radio transceiver, an antenna has a fixed element and a movable element. When the movable element is in an extended state, the movable element functions. On the other hand, when the movable element is in a retracted state, the fixed element functions. An impedance matching circuit preferentially performs impedance matching relative to the fixed element. A reactance element is further provided which is connected to the movable element when the movable element is in the extended state. On the other hand, the reactance element is out of connection to the movable element when the movable element is in the retracted state. With this arrangement, the impedance matching circuit and the reactance element cooperatively achieve impedance matching relative to the movable element when the movable element functions. Alternatively, if the impedance matching circuit preferentially performs impedance matching relative to the movable element, the reactance element is connected to the fixed element when the fixed element functions.

4 Claims, 19 Drawing Sheets

FIG.4

| ELEMENT TO FUNCTION | CONNECTION STATE RELATIVE TO MATCHING CKT | | | |
|---|---|---|---|---|
| | L ELEMENT | REACTANCE ELEMENT | S ELEMENT | REACTANCE ELEMENT |
| COMM STATE (EXTENDED) | L ELEMENT | CONNECTED | CONNECTED | DISCONNECTED | DISCONNECTED |
| STANDBY STATE (RETRACTED) | S ELEMENT | DISCONNECTED | DISCONNECTED | CONNECTED | DISCONNECTED |

FIG.19
PRIOR ART

| | ELEMENT TO FUNCTION | CONNECTION STATE RELATIVE TO MATCHING CKT | |
|---|---|---|---|
| | | L ELEMENT | S ELEMENT |
| COMM STATE (EXTENDED) | L ELEMENT | CONNECTED OR IN STATE OF CLOSE COUPLING | DISCONNECTED OR IN STATE OF LOOSE COUPLING |
| STANDBY STATE (RETRACTED) | S ELEMENT | DISCONNECTED OR IN STATE OF LOOSE COUPLING | CONNECTED OR IN STATE OF CLOSE COUPLING |

ANTENNA WITH FIXED AND MOVABLE ELEMENTS

BACKGROUND OF THE INVENTION

1. Field of the Invention

The present invention relates to a radio transceiver which, when an antenna includes a plurality of elements having different impedances, is capable of achieving impedance matching relative to each of the elements.

2. Description of the Prior Art

In general, a radio transceiver needs to be equipped with an antenna of a given length for minimizing power loss on transmission and reception of radio waves. However, the antenna becomes relatively long in general, which makes the radio transceiver unhandy and could cause of breakage or failure of the radio transceiver. Under these circumstances, an antenna of a relatively short length has been used, while suppressing power loss using a matching circuit to match the impedance of a signal source and the relatively short antenna.

The situation also applies to an automobile telephone, a portable telephone and the like which have been widely available in recent years. Particularly, in case of the portable telephone, since it is usually carried by being put in a pocket, a bag or the like, a short antenna is required. Further, since the portable telephone is driven by a battery or the like, it is also required that radio waves be transmitted and received with high efficiency.

For satisfying these requirements, a method is considered wherein the antenna is used in an extended state during communication, while retracted in a casing during off-communication Specifically, the antenna is retracted in the casing in a state of waiting for a call (hereinafter referred to as "standby state"), while the antenna is used extended from the casing when calling or in a state of communication (hereinafter both will be referred to as "communication state" for simplicity).

FIGS. 16A and 16B are block diagrams each showing a circuit of a conventional mobile radio transceiver, wherein FIG. 16A shows the communication state and FIG. 16B shows the standby state. The shown mobile radio transceiver is a mobile cellular telephone as an example.

The radio transceiver 100 includes a receiving section 101, a transmitting section 102, a duplexer 103 connected to the receiving section 101 and the transmitting section 102 and separating receiving waves and transmitting waves, and a matching circuit 104 connected between the duplexer 103 and an antenna 105 for matching the impedance therebetween so as to suppress power loss.

The antenna 105 includes a long element (hereinafter referred to as "L element") 105*a* which functions in the communication state and a short element (hereinafter referred to as "S element") 105*b* which functions in the standby state. Switching means 107 is provided for switching between the L element 105*a* and the S element 105*b* for connection to the matching circuit 104.

In FIGS. 16A and 16B, the switching means 107 is shown as a change-over switch. However, in practice, as shown in FIGS. 17A, 17B and 18A, 18B, the switching between the L element 105*a* and the S element 105*b* is performed mechanically in response to the extending/retracting operation of the antenna 105, that is, the L element 105*a*. FIG. 17A shows the standby state where the antenna 105 is retracted, while FIG. 18A shows the communication state where the antenna 105 is extended. FIGS. 17B and 18B are conceptual circuit diagrams corresponding to FIGS. 17A and 18A, respectively, along with illustration of the matching circuits 104.

The S element 105*b* has a helical structure and is provided at its end portion remote from its tip, that is, at its lower end portion in FIGS. 17A~18B, with a feeder terminal 125 having a connecting terminal 150. To the feeder terminal 125 is fed a radio-wave signal from the matching circuit 104. The L element 105*a* includes a conductive part 123, an insulating member 122 covering an upper portion of the conductive part 123, and a connection terminal 151 provided at an end portion of the L element 105*a* remote from its tip, that is, at a lower end portion of the L element 105*a* in the figures. The L element 105*a* of a whip structure is coaxially and movably retracted in and through the helical S element 105*b*.

In the foregoing structure, as shown in FIGS. 18A and 18B, the L element 105*a* is extended in the communication state to cause the connection terminal 151 to be in contact with the connecting terminal 150 so that the L element 105*a* is fed with the radio-wave signal from the matching circuit 104. Numeral 152 represents a stopper for limiting the extending movement of the L element 105*a* relative to the S element 105*b*.

On the other hand, in the standby state, the L element 105*a* is pushed toward the S element 105*b* so as to be retracted in the S element 105*b* and a casing of the radio transceiver 100. Since the insulating member 122 is set to be somewhat longer than a length of the S element 105*b*, the conductive part 123 of the L element 105*a* is ensured to be out of contact with the S element 105*b* during the standby state as shown in FIG. 17A. In the standby state, since the connection terminal 151 is out of contact with the connecting terminal 150, the signal from the matching circuit 104 is only fed to the S element 105*b*.

FIG. 19 is a diagram summarizing connection states between the L and S elements 105*a*, 105*b* and the matching circuit 104 in the communication state and the standby state. As seen from the figure, in the communication state, the L element 105*a* is connected to or in a state of close coupling with the matching circuit 104 and the S element 105*b* is out of connection to or in a state of loose coupling with the matching circuit 104 so that the L element 105*a* functions. On the other hand, in the standby state, the L element 105*a* is out of connection to or in a state of loose coupling with the matching circuit 104 and the S element 105*b* is connected to or in a state of close coupling with the matching circuit 104 so that the S element 105*b* functions.

In the foregoing structure, however, since the impedance matching should be performed relative to the L element 105*a* and the S element 105*b*, respectively, using the single matching circuit 104, it is difficult to achieve the optimum impedance matching relative to each of the L and S elements.

Specifically, since, in general, it is rare that impedances of the different-length elements seen from the matching circuit 104 have the same value, the impedance matching has been executed in either of the following manners:

One is that the impedance matching is performed with priority to either one of the L and S elements 105*a* and 105*b*, and the other is that the incomplete impedance matching is performed relative to each of the L and S elements 105*a* and 105*b* so as to reduce the power loss on the whole.

In the former case where the impedance matching is performed with priority to one of the L and S elements, the impedance matching is not performed for the other element.

Accordingly, if, for example, the impedance matching is executed for the communication state, reception of a call becomes difficult since the impedances are not matched for the standby state.

On the other hand, in the latter case where the incomplete impedance matching is executed for each of the L and S elements, the power loss inevitably becomes greater as compared with the complete impedance matching for each of the L and S elements. This is disadvantageous particularly in a portable telephone or the like driven by a battery in which the power loss needs to be as small as possible.

SUMMARY OF THE INVENTION

Therefore, it is an object of the present invention to provide an improved mobile radio transceiver.

According to one aspect of the present invention, a mobile radio transceiver having an antenna which includes a fixed element and a movable element, the movable element is arranged to function when the movable element is in an extended state, while the fixed element is arranged to function when the movable element is in a retracted state, comprises impedance matching means for changing a matching impedance thereof depending on the extended or retracted state of the movable element, the impedance matching means performing impedance matching to the movable element when the movable element is in the extended state and performing impedance matching to the fixed element when the movable element is in the retracted state; and switching means for switching an electric connection state of the impedance matching means depending on the extended or retracted state of the movable element.

BRIEF DESCRIPTION OF THE DRAWINGS

The present invention will be understood more fully from the detailed description given hereinbelow, taken in conjunction with the accompanying drawings.

In the drawings

FIGS. 1A and 1B are block diagrams each showing a circuit of a mobile radio transceiver according to a first preferred embodiment of the present invention, wherein FIG. 1A shows a communication state and FIG. 1B shows a standby state;

FIGS. 2A and 2B are diagrams each showing a structure of an antenna in a standby state used in the mobile radio transceiver shown in FIGS. 1A and 1B, wherein FIG. 2A is a front view of the antenna and FIG. 2B is a schematic circuit diagram of the antenna;

FIGS. 3A and 3B are diagrams each showing a structure of the antenna of FIGS. 1A and 1B in a communication state, wherein FIG. 3A is a front view of the antenna and FIG. 3B is a schematic circuit diagram of the antenna;

FIG. 4 is a diagram summarizing connection states between a movable L element of the antenna, a fixed S element of the antenna, a reactance element and a matching circuit shown in FIGS. 1A and 1B;

FIGS. 5A and 5B are block diagrams each showing a circuit of a mobile radio transceiver according to another preferred embodiment of the present invention, wherein a matching circuit preferentially perform impedance matching relative to a movable L element of an antenna and wherein FIG. 5A shows a communication state and FIG. 5B shows a standby state;

FIGS. 6A and 6B are block diagrams each showing a circuit of a mobile radio transceiver according to another preferred embodiment of the present invention, wherein a reactance element is connected in series between a matching circuit and switching means in a communication state and wherein FIG. 6A shows the communication state and FIG. 6B shows a standby state;

FIGS. 7A and 7B are diagrams each showing a schematic circuit of an antenna according to another preferred embodiment of the present invention, wherein a reactance element is connected to a matching circuit via a reed switch and wherein FIG. 7A shows a communication state and FIG. 7B shows a standby state;

FIGS. 10A and 10B are diagrams each showing a structure of an antenna in communication state according to another preferred embodiment of the present invention, wherein connection between a matching circuit and a movable L element is achieved by capacitive coupling and wherein FIG. 10A is a front view of the antenna and FIG. 10B is a schematic circuit diagram of the antenna;

FIGS. 11A and 11B are diagrams each showing a structure of the antenna of FIGS. 10A and 10B in a standby state, wherein FIG. 11A is a front view of the antenna and FIG. 11B is a schematic circuit diagram of the antenna;

FIG. 14A and 14B are diagrams each showing a structure of an antenna in a communication state according to another preferred embodiment of the present invention, wherein connection between a reactance element and a movable L element is achieved by capacitive coupling and wherein FIG. 14A is a front view of the antenna and FIG. 14B is a schematic circuit diagram of the antenna;

FIGS. 15A, 15B and 15C are diagrams each showing a result of an experiment in terms of reflection coefficient and VSWR (voltage standing wave ratio) characteristic of a mobile radio transceiver, wherein FIG. 15A shows a standby state with a reactance element being out of connection to an antenna, FIG. 15B shows a communication state with the reactance element being out of connection to the antenna, and FIG. 15C shows a communication state with the reactance element being connected to the antenna;

FIGS. 16A and 16B are block diagrams each showing a circuit of a conventional mobile radio transceiver, wherein FIG. 16A shows a communication state and FIG. 16B shows a standby state;

FIGS. 17A and 17B are diagrams each showing a structure of an antenna a standby state used in the conventional mobile radio transceiver, wherein FIG. 17A is a front view of the antenna and FIG. 17B is a schematic circuit diagram of the antenna;

FIGS. 18A and 18B are diagrams each showing a structure of the antenna of FIGS. 17A and 17B in a communication state, wherein FIG. 18A is a front view of the antenna and FIG. 18B is a schematic circuit diagram of the antenna; and FIG. 19 is a diagram summarizing connection states between L and S elements of the antenna and a matching circuit shown in FIGS. 16A and 16B.

DESCRIPTION OF THE PREFERRED EMBODIMENT

Now, preferred embodiments of the present invention will be described hereinbelow with reference to the accompanying drawings.

First Embodiment

Figure 1A:
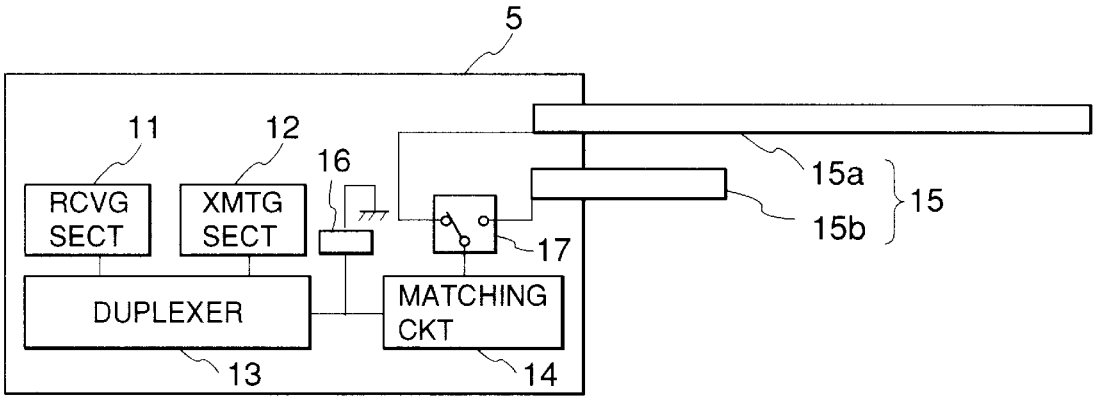
Figure 1B:
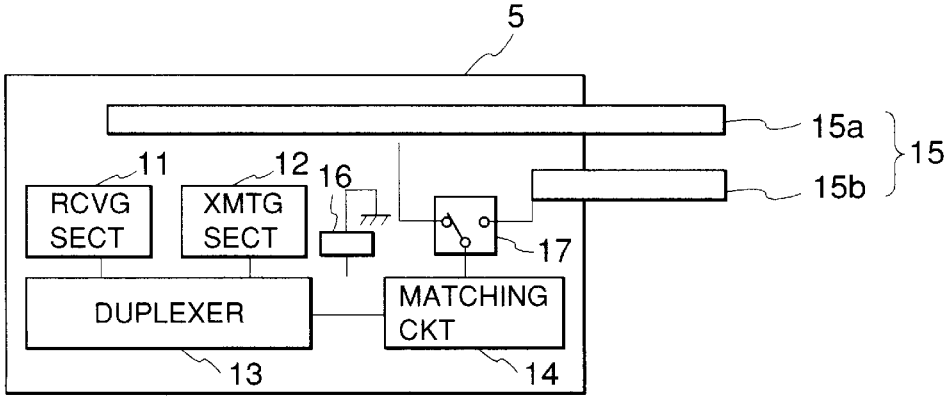
Figure 2A:
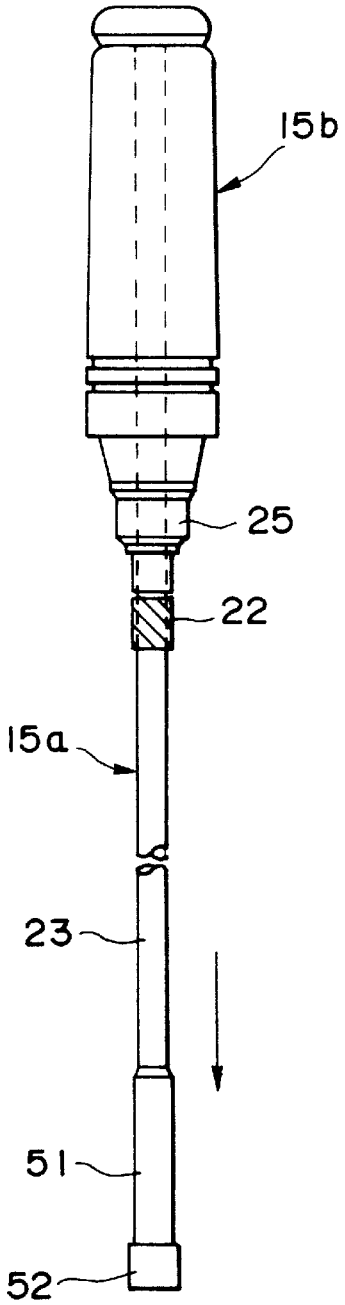
Figure 2B:
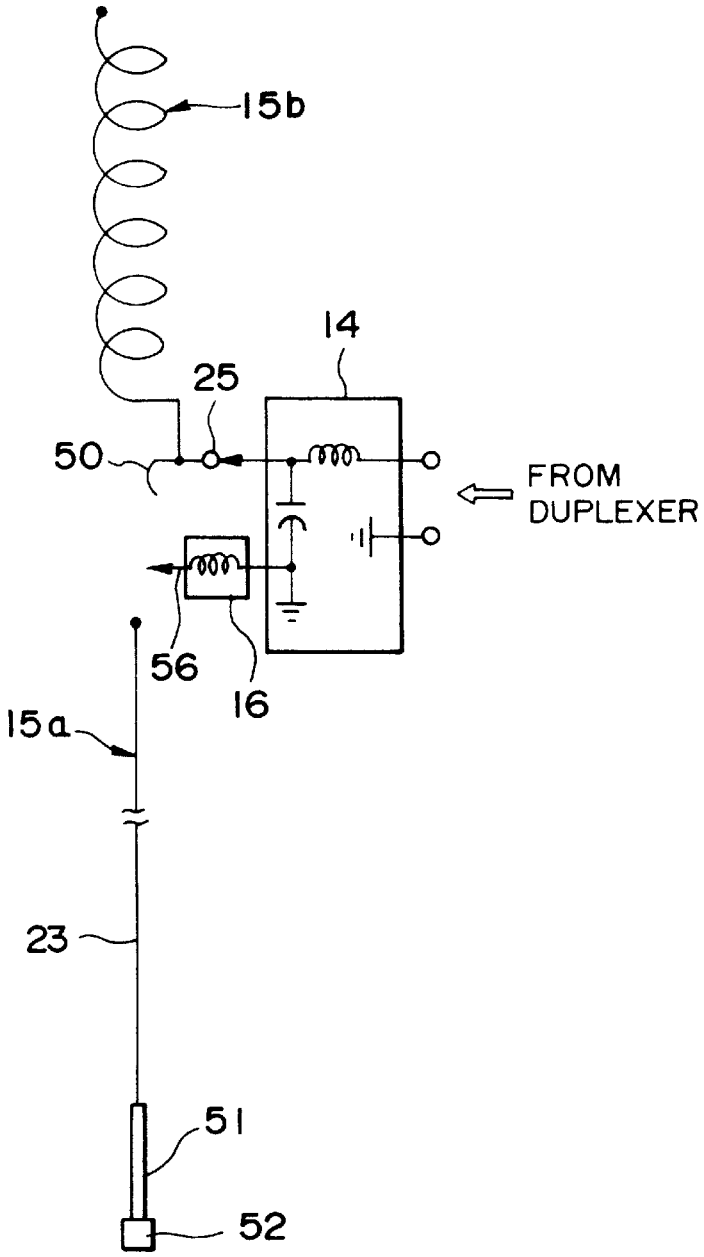
Figure 3A:
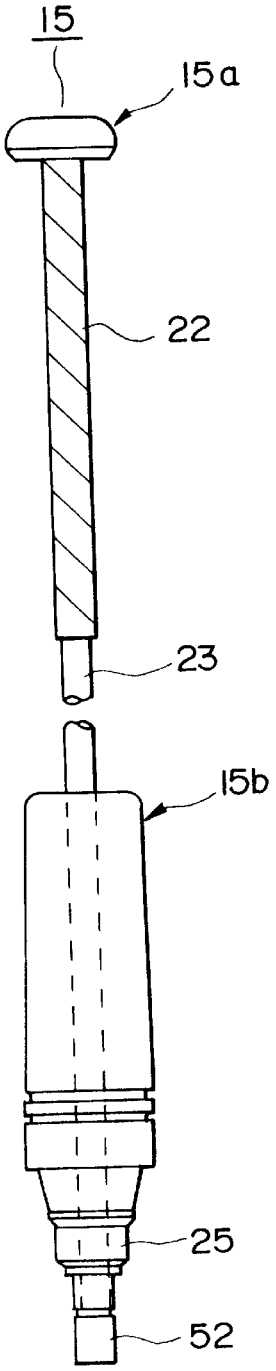
Figure 3B:
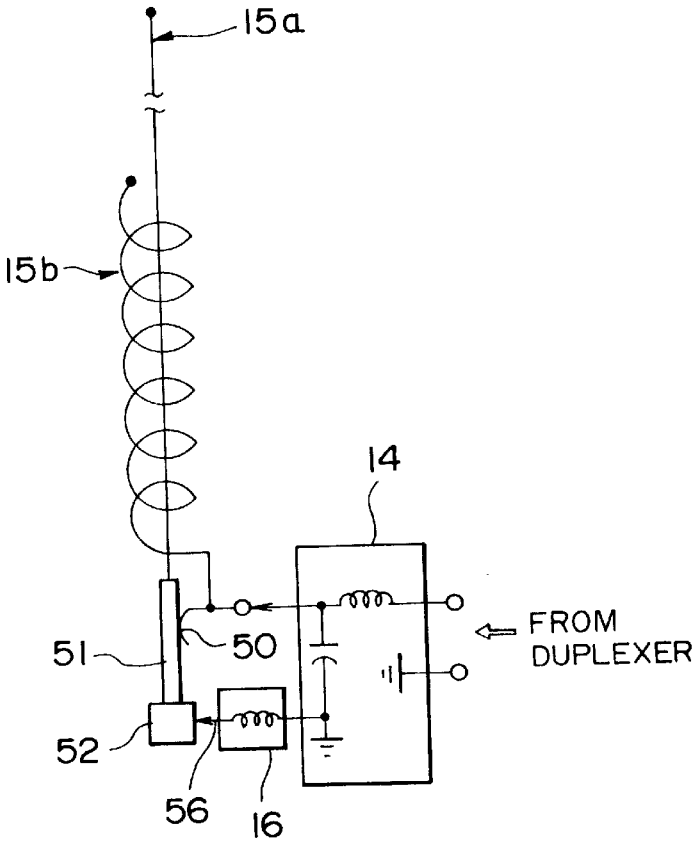

FIGS. 1A and 1B are block diagrams each showing a circuit of a mobile radio transceiver according to a first preferred embodiment of the present invention, wherein FIG. 1A shows a communication state and FIG. 1B shows a standby state. The shown mobile radio transceiver is a mobile cellular telephone as an example. FIGS. 2A, 2B, 3A and 3B are diagrams each showing a structure of an antenna used in the mobile radio transceiver shown in FIGS. 1A and 1B, wherein FIG. 2A shows the standby state and FIG. 3A shows the communication state. FIGS. 2B and 3B are conceptual circuit diagrams corresponding to FIGS. 2A and 3A, respectively, along with illustration of a matching circuit 14 and a reactance element 16 as impedance matching means. The fundamental structure of the radio transceiver is approximately the same except for provision of the reactance element 16.

The radio transceiver 5 includes a receiving section 11 for converting a received radio-wave signal into voice or data, a transmitting section 12 for converting voice or data into a radio-wave signal, a duplexer 13 connected to the receiving section 11 and the transmitting section 12 and separating received waves and transmitted waves, and the matching circuit 14 and the reactance element 16 are connected between the duplexer 13 and an antenna 15 for matching the impedances therebetween so as to suppress power loss.

The antenna 15 includes a movable element or a long (L) element 15*a* and a fixed element or a short (S) element 15*b*. Switching means 17 is provided for setting the L element 15*a* to function in the communication state and for setting the S element 15*b* to function in the standby state. The reactance element 16 is connected to the switching means 17 at a side of the L element 15*a*. The reactance element 16 may be either capacitive or inductive. In this preferred embodiment, the matching circuit 14 is arranged to match the impedance between the duplexer 13 and the S element 15*b*.

In FIGS. 1A and 1B, the switching means 17 is shown as a change-over switch. However, in practice, as shown in FIGS. 2A, 2B and 3A, 3B, the switching between the L element 15*a* and the S element 15*b* is performed mechanically in response to the extending/retracting operation of the antenna 15, that is, the L element 15*a*. Specifically, the switching means 17 is constituted by a connecting terminal 50 fixed to a feeder terminal 25, a connection terminal 51 provided at an end portion of the L element 15*a* remote from its tip, that is, at a lower end portion of the L element 15*a* in FIGS. 2A~3B, and arranged to be in contact with the connecting terminal 50 when the L element 15*a* is extended or in an extended state, an impedance matching means connection terminal 52 of the L element 15*a* provided adjacent to the connection terminal 51, and an impedance matching means connecting terminal 56 connected to the impedance element 16.

The S element 15*b* has a helical structure and the L element 15*a* of a whip structure coaxially retracts therethrough. The S element 15*b* is provided with the feeder terminal 25 having the connecting terminal 50 as described above and fed with a radio-wave signal from the matching circuit 14.

The L element 15*a* has a conductive part 23 which is covered by an insulating member 22 at its upper portion and provided at its lower side with the connection terminal 51 and the impedance matching means connection terminal 52 arranged adjacent to the connection terminal 51 and working also as a stopper when the L element 15*a* is extended through the S element 15*b*.

With the foregoing structure, in the standby state as shown in FIGS. 2A and 2B, the L element 15*a* is in a retracted state, that is, the L element 15*a* is retracted in the S element 15*b* and a casing of the radio transceiver 5. Since the insulating member 22 is set to be approximately equal to but longer than a length of the S element 15*b*, the conductive part 23 of the L element 15*a* is ensured to be out of contact with the S element 15*b* during the standby state as shown in FIG. 2A. In the standby state, the connection terminal 51 is out of contact with the connecting terminal 50 and the impedance matching means connection terminal 52 is out of contact with the impedance matching means connecting terminal 56. Accordingly, the radiowave signal from the matching circuit 14 is only fed to the S element 15*b*.

On the other hand, when the L element 15*a* is extended to be set in the communication state as shown in FIGS. 3A and 3*b*, the connection terminal 51 is connected to the connecting terminal 50 and the impedance matching means connection terminal 52 is connected to the impedance matching means connecting terminal 56. Accordingly, the impedance matching between the L element 15*a* and the duplexer 13 is achieved cooperatively by the matching circuit 14 and the reactance element 16 which is connected only in the communication state.

FIG. 4 is a diagram summarizing connection states between the L and S elements 15*a*, 15*b*, the reactance element 16 and the matching circuit 14 effected by the switching means 17. As seen from the figure, in the communication state, the L element 15*a* is connected to the matching circuit 14 and the reactance element 16 is connected to the L element 15*a* so as to allow the L element 15*a* to function. On the other hand, in the standby state, only the S element 15*b* is connected to the matching circuit 14 and the reactance element 16 is out of connection to the S element 15*b* so as to allow the S element 15*b* to function.

As described before, the matching circuit 14 is arranged to match the impedance relative to the S element 15*b*. Accordingly, the impedance matching relative to the L element 15*a* is incomplete. In this regard, in the communication state, the reactance element 16 is connected to the L element 15*a* to achieve the impedance matching for the L element 15*a* cooperatively with the matching circuit 14. With this arrangement, the power loss can be minimized in either of the standby state and the communication state.

Figure 15A:
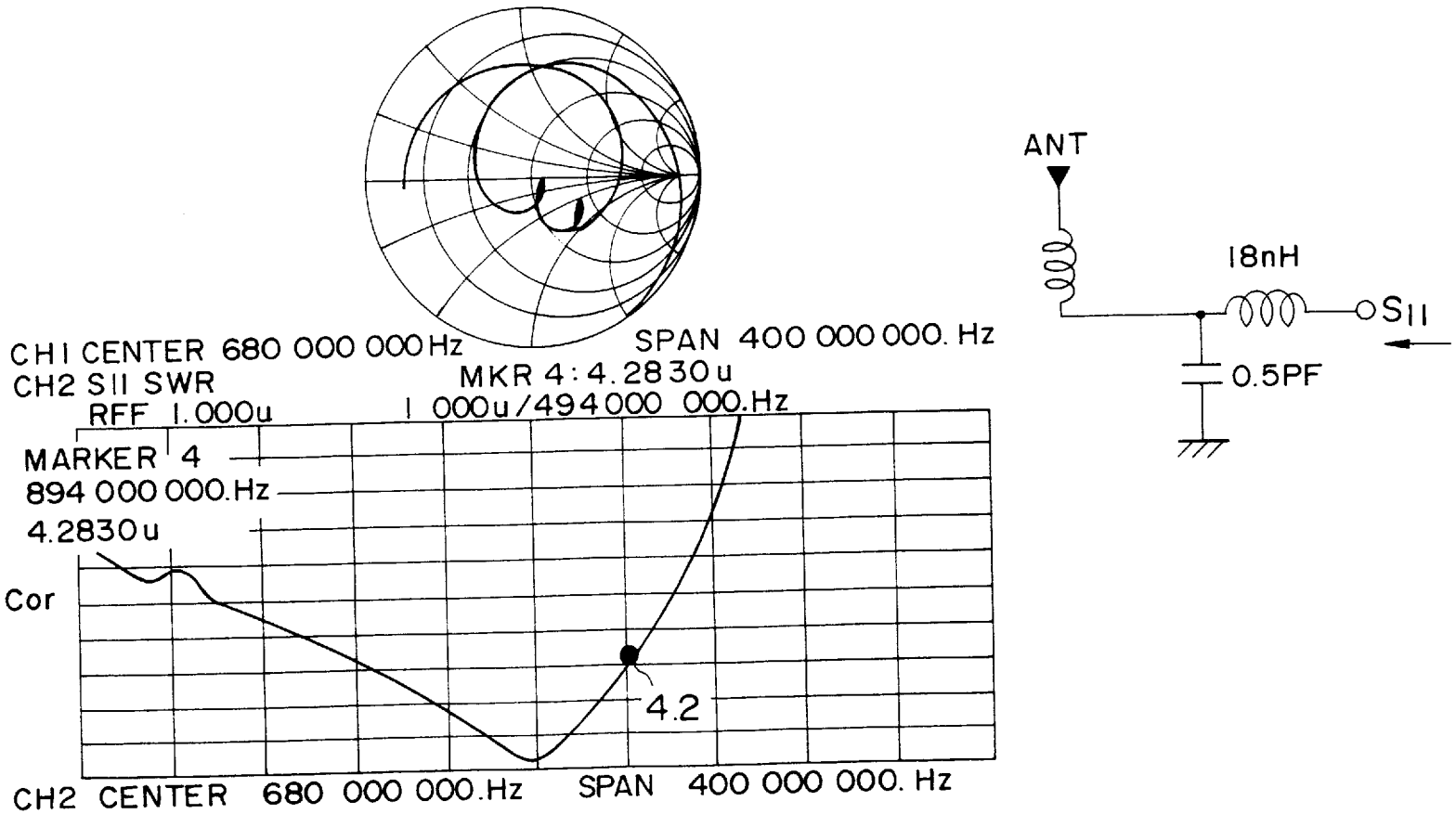
Figure 15B:
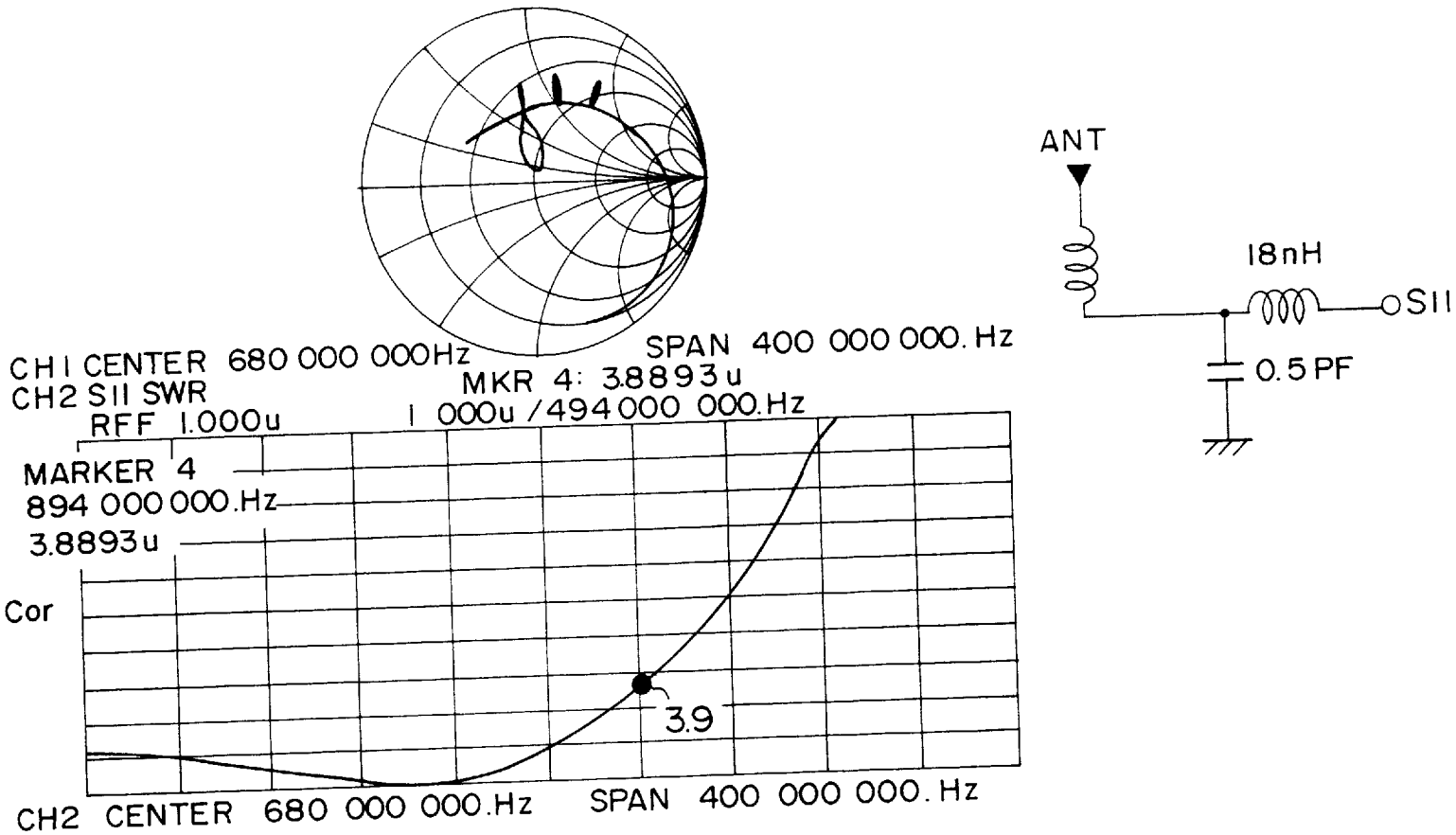
Figure 15C:
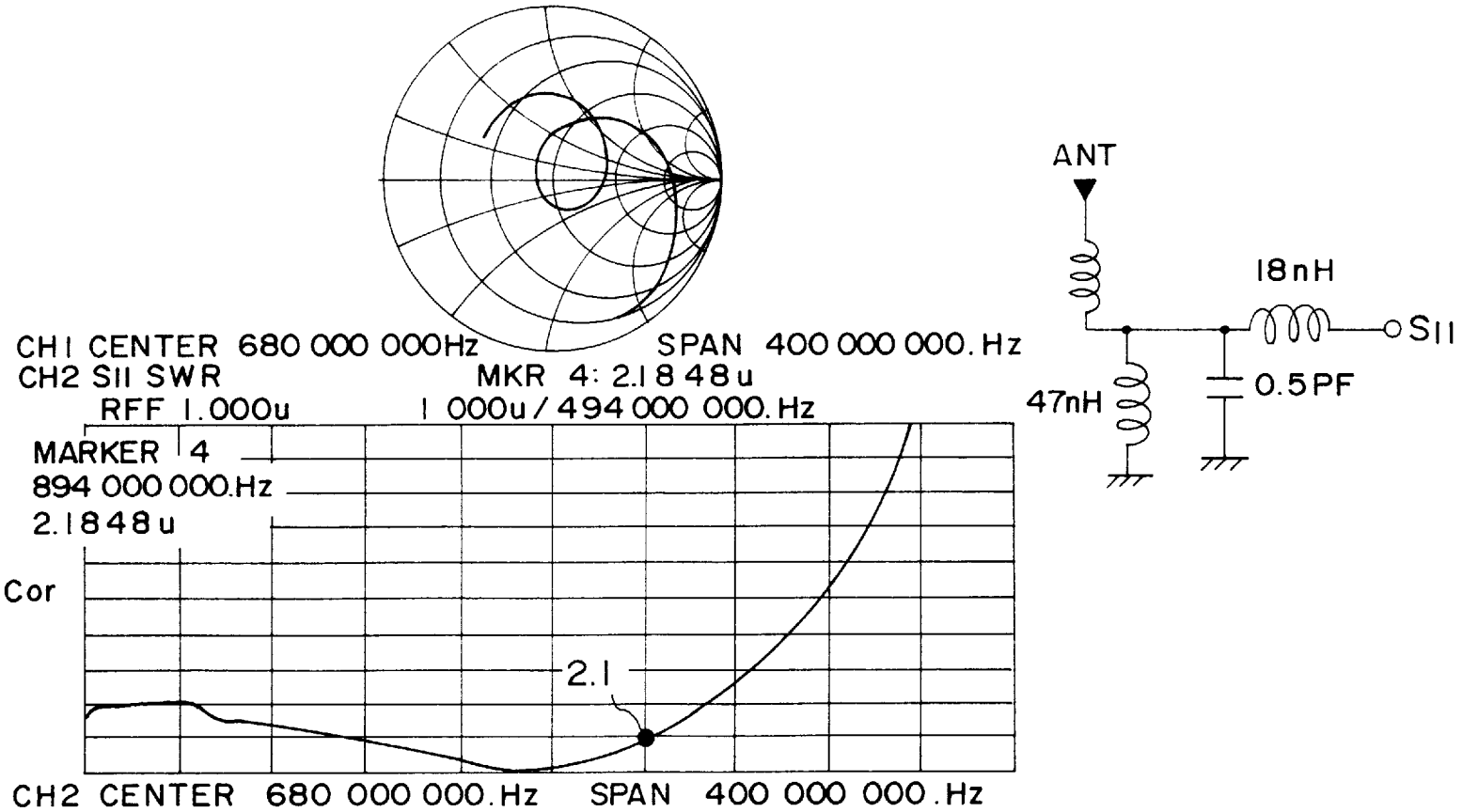
Figure 16A:
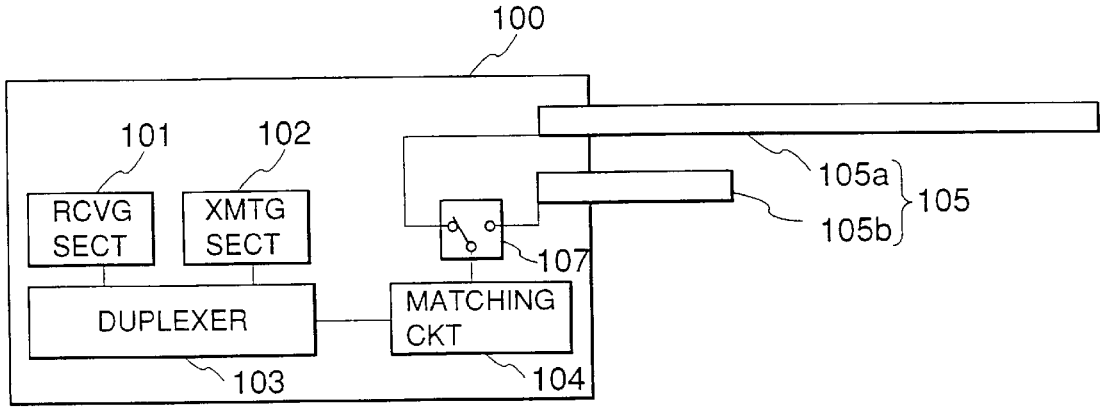
FIG.16A PRIOR ART
Figure 16B:
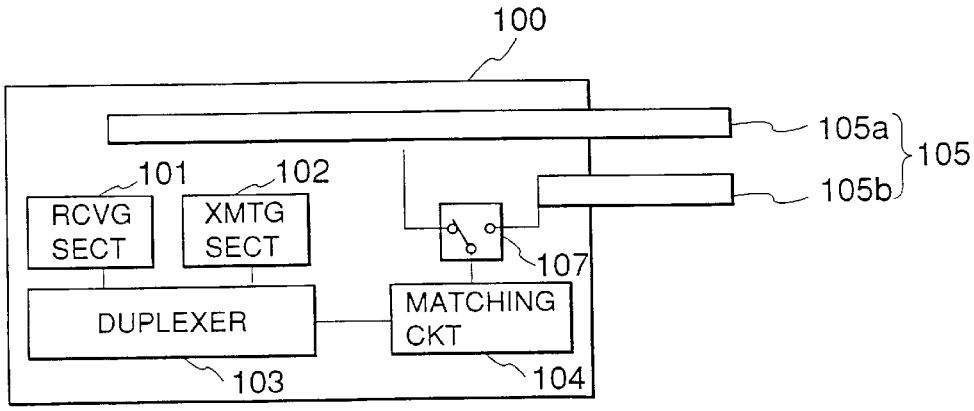
FIG.16B PRIOR ART
Figure 17A:
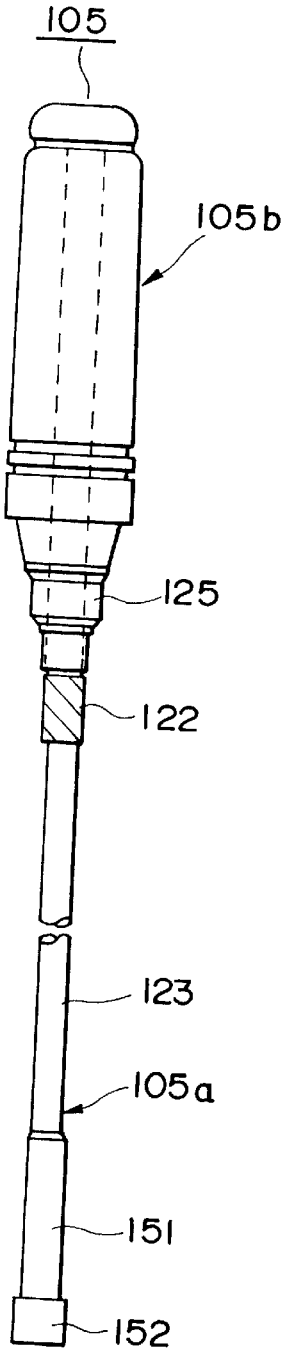
FIG. 17A PRIOR ART
Figure 17B:
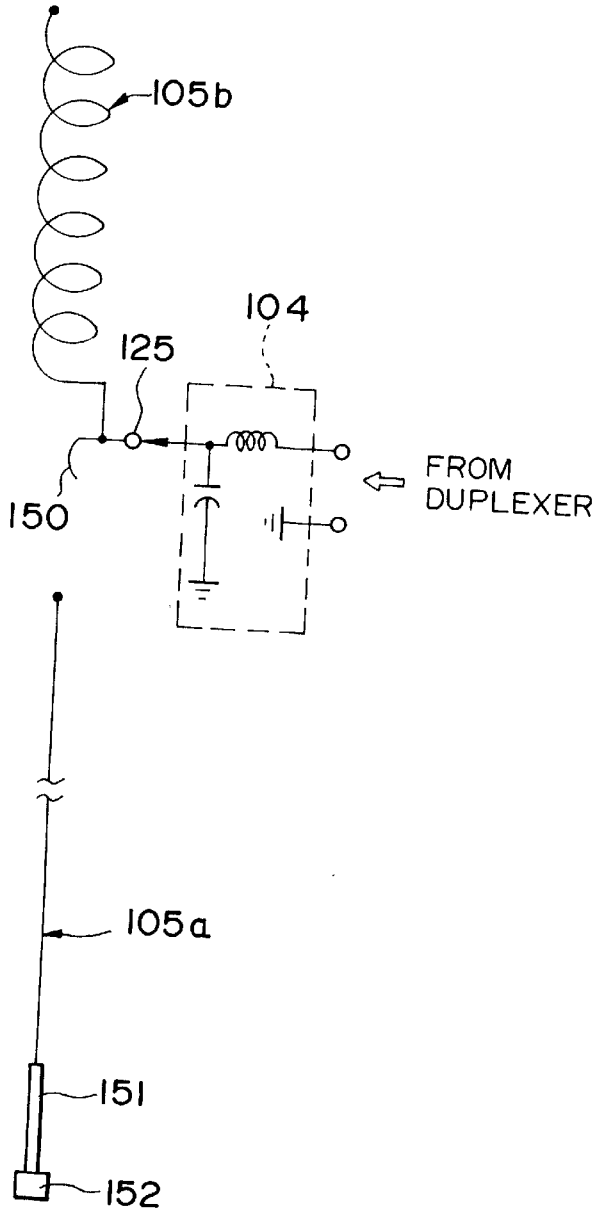
FIG. 17B PRIOR ART
Figure 18A:
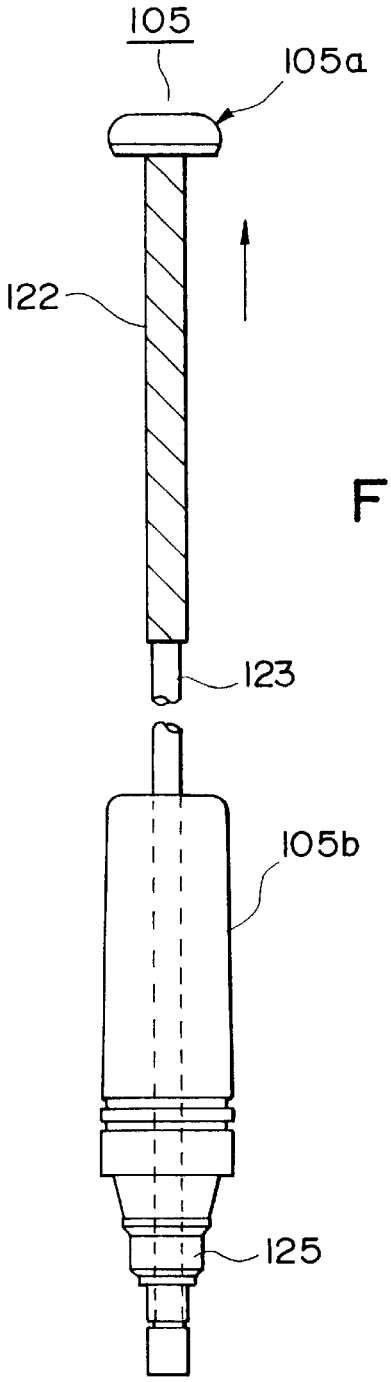
FIG. 18A PRIOR ART
Figure 18B:
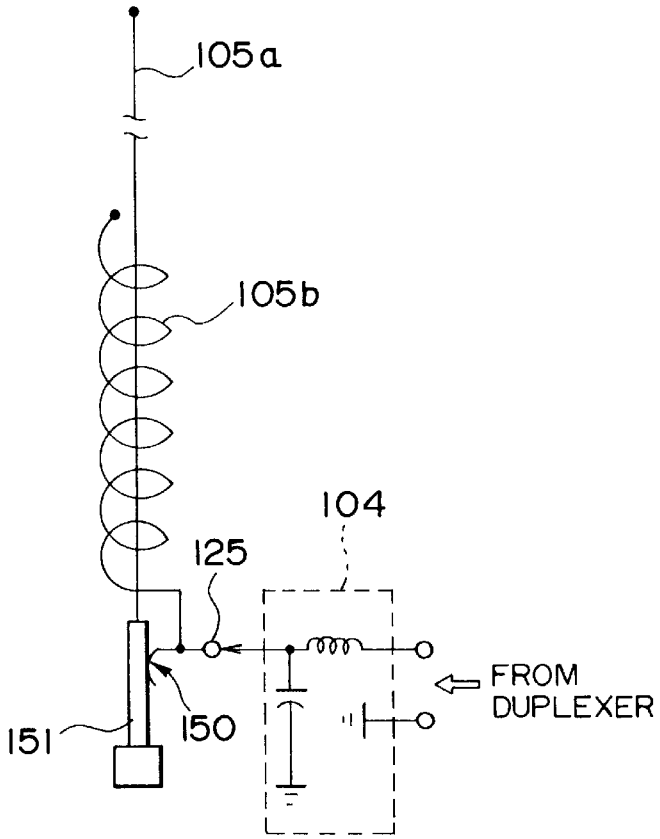
FIG. 18B PRIOR ART

FIGS. 15A, 15B and 15C are diagrams each showing a result of an experiment using a mobile radio transceiver in the North American cellular telephone system (transmitting frequency band: 824~849 MHz; receiving frequency band: 869~894 MHz), wherein the result is shown in terms of reflection coefficient and VSWR (voltage standing wave ratio) characteristic of a 50 W system as seen from the duplexer 13. Specifically, FIG. 15A shows the standby state with the reactance element 16 being out of connection to the antenna 15, FIG. 15*B* shows the communication state with the reactance element 16 being out of connection to the antenna 15, and FIG. 15C shows the communication state with the reactance element 16 being connected to the antenna 15.

In the experiments, the L element 15*a* having a length of 150 mm and the inductive reactance element 16 having a reactance of 47 nH were used. Further, it was arranged that the impedance matching means connecting terminal 56 connected to the reactance element 16 was urged to be in contact with the impedance matching means connection terminal 52 by means of a spring.

As seen from the figures, in the communication state, the VSWR characteristic with the reactance element 16 out of connection represented a notably bad value of 3.9 at a high receiving frequency band (see FIG. 15B), while it was largely improved to a value of 2.1 when using the reactance element 16 (see FIG. 15C). Accordingly, a mismatching loss was largely improved by 1.5 dB, that is, from 2 dB to 0.5 dB.

Other Embodiments

Other preferred embodiments will be described hereinbelow with reference to the accompanying drawings. The same or like components are represented by the same reference symbols as those in the foregoing first preferred embodiment so as to omit explanation thereof.

In the foregoing first preferred embodiment, the matching circuit 14 is arranged to preferentially perform the impedance matching for the S element 15*b* rather than the L element 15*a*, which, however, may be reversed.

Figure 5A:
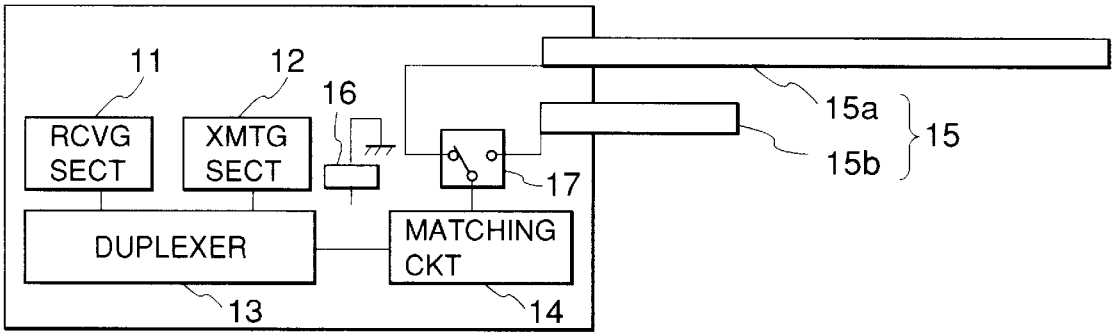
Figure 5B:
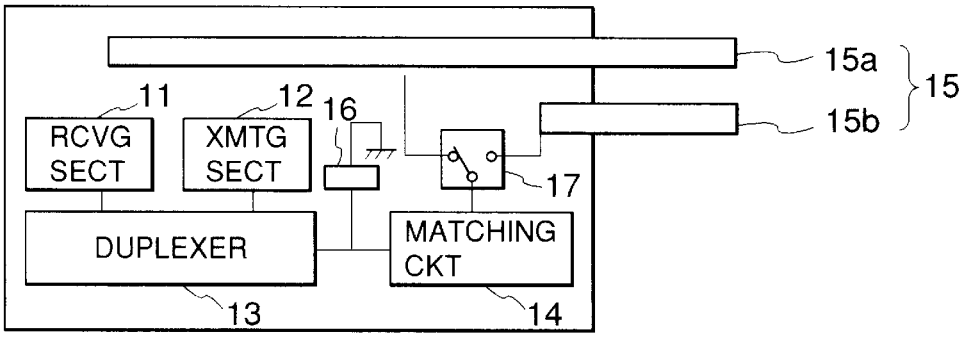

Specifically, in FIGS. 5A and 5B, the matching circuit 14 is arranged to preferentially perform the impedance matching relative to the movable element or the L element 15*a* rather than the fixed element or the S element 15*b*. When the L element 15*a* is extended through the S element 15*b*, the reactance element 16 is arranged to be out of connection to the S element 15*b*. On the other hand, when the L element 15*a* is in the retracted state, the reactance element 16 is arranged to be connected to the S element 15*b*. With this arrangement, the impedance matching relative to the S element 15*b* can also be achieved.

Further, the reactance element 16 may be connected between the matching circuit 14 and the switching means 17 either in series or in parallel.

Figure 6A:
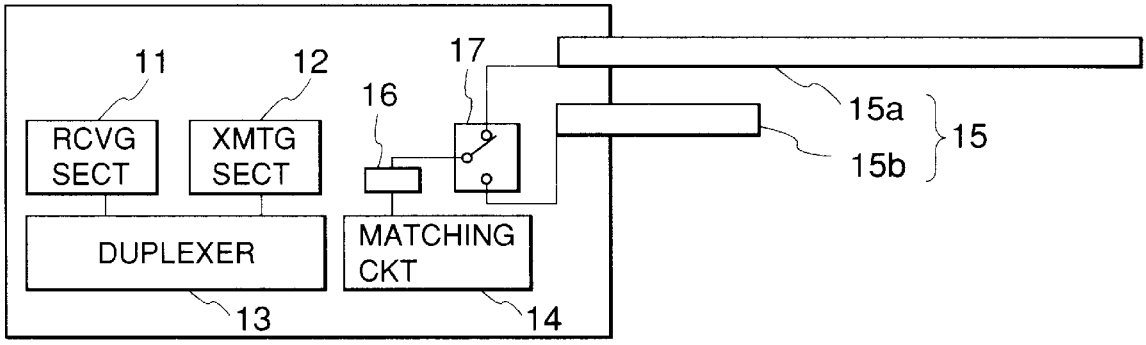
Figure 6B:
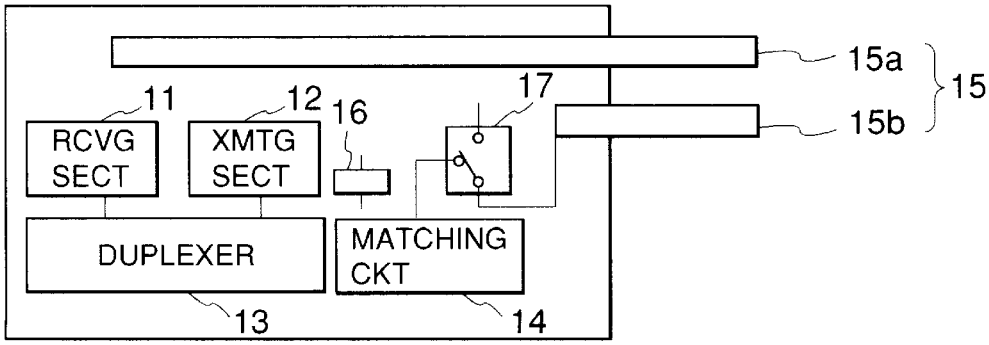

For example, in FIGS. 6A and 6B, the reactance element 16 is connected in series between the matching circuit 14 and the switching means 17 in the communication state (FIG. 6A), while this connection is released in the standby state (FIG. 6B). Also in this preferred embodiment, connection and disconnection of the reactance element 16 are performed in response to the extending/retracting operation of the L element 15*a*.

Further, the mechanism for connection between the reactance element 16 and the impedance matching means connection terminal 52 may take another form rather than that of the first preferred embodiment as long as the connection state between the reactance element 16 and the impedance matching means connection terminal 52 can be changed between "connected" and "disconnected". Accordingly, the connection mechanism is not limited to the foregoing manner where the reactance element 16 is provided with the impedance matching means connecting terminal 56.

Figure 7A:
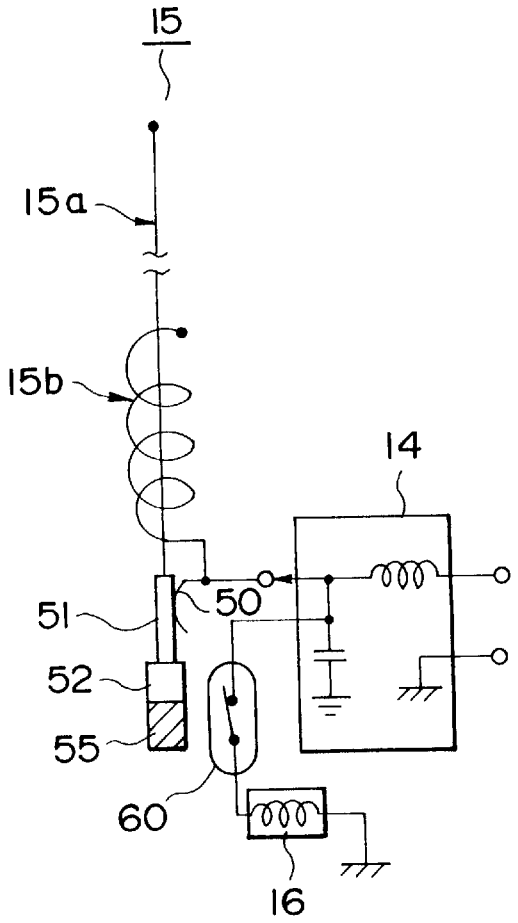
Figure 7B:
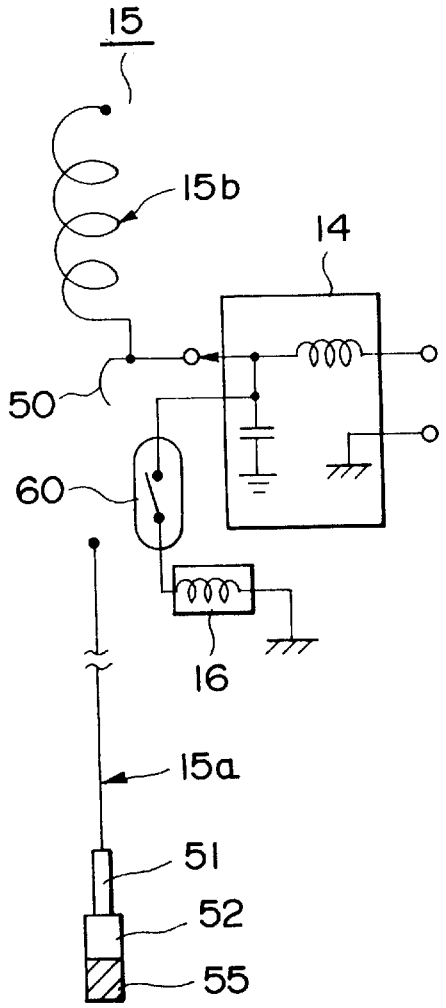

For example, in FIGS. 7A and 7B, a magnet 55, such as a permanent magnet, is fixed to a lower side, in the figures, of the impedance matching means connection terminal 52 of the L element 15*a*, and a reed switch 60 is connected between the reactance element 16 and the matching circuit 14. It is arranged that the reed switch 60 is located close to a stop position of the magnet 55 when the L element 15*a* is in the extended state.

With this arrangement, when the L element 15*a* is extended through the S element 15*b*, the reed switch 60 is closed due to a magnetic force of the magnet 55 so that the reactance element 16 is connected to the matching circuit 14 (see FIG. 7A). On the other hand, when the L element 15*a* is in the retracted state, since the magnet 55 goes away from the reed switch 60, the reed switch 60 is opened so that the reactance element 16 gets out of connection to the matching circuit 14 (see FIG. 7B). In this embodiment, the switching means 17 is constituted by the connecting terminal 50, the connection terminal 51, the magnet 55 and the reed switch 60.

Figure 8:
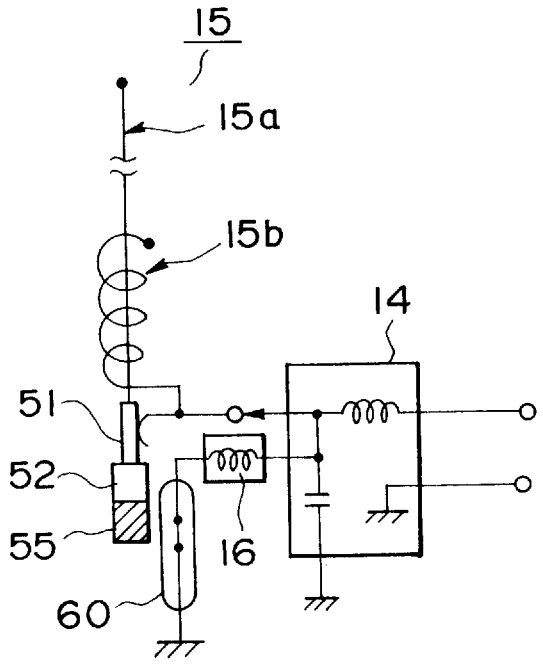
FIG. 8 is a schematic circuit diagram of an antenna according to a modification FIGS. 7A and 7B.
Figure 9:
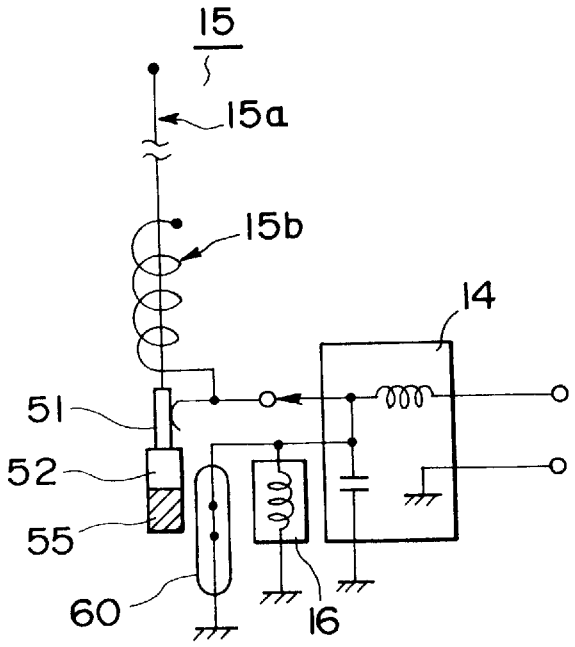
FIG. 9 is a schematic circuit diagram of an antenna according to another modification of FIGS. 7A and 7B.

A positional arrangement of the reactance element 16 relative to the reed switch 60 may be changed as shown in FIGS. 8 and 9. In FIG. 8, the reactance element 16 is connected in series between the matching circuit 14 and the reed switch 60. On the other hand, in FIG. 9, the reactance element 16 is connected in parallel to the reed switch 60.

Further, as shown in FIGS. 10A, 10B and 11A, 11B, the connection between the matching circuit 14 and the L element 15*a* may be achieved by capacitive coupling.

Figure 10A:
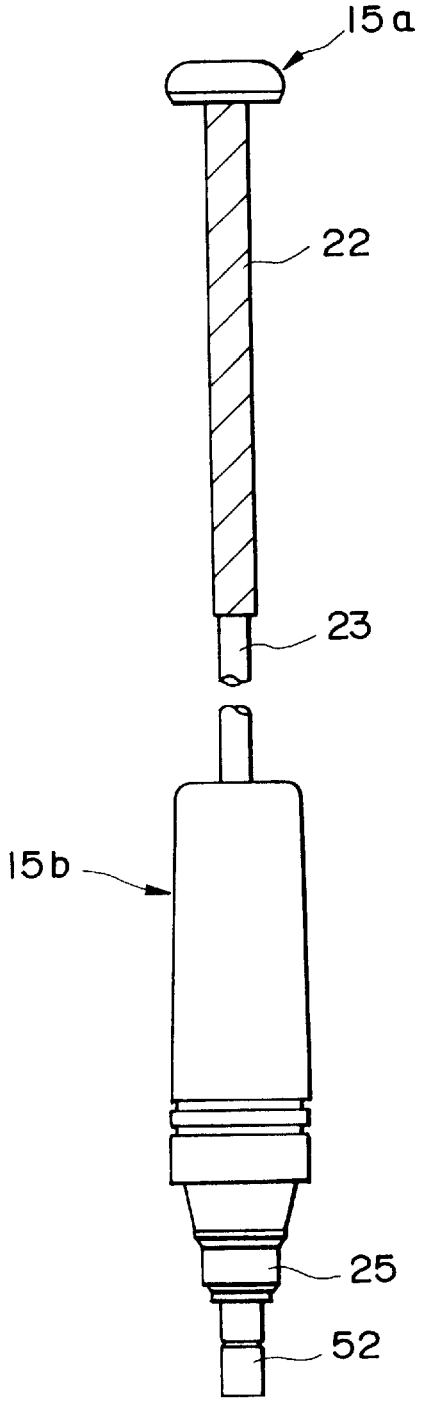
Figure 10B:
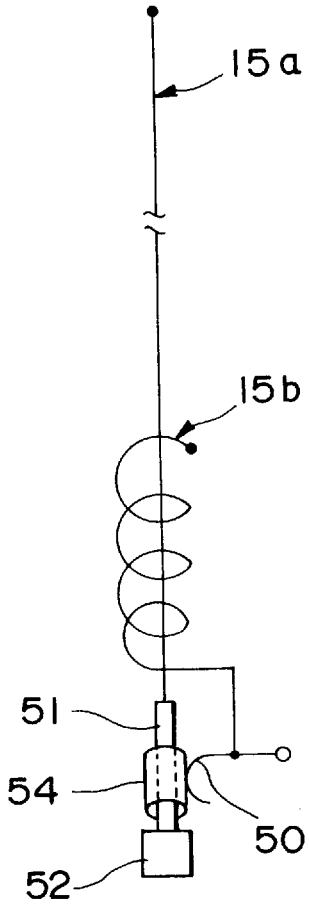
Figure 11A:
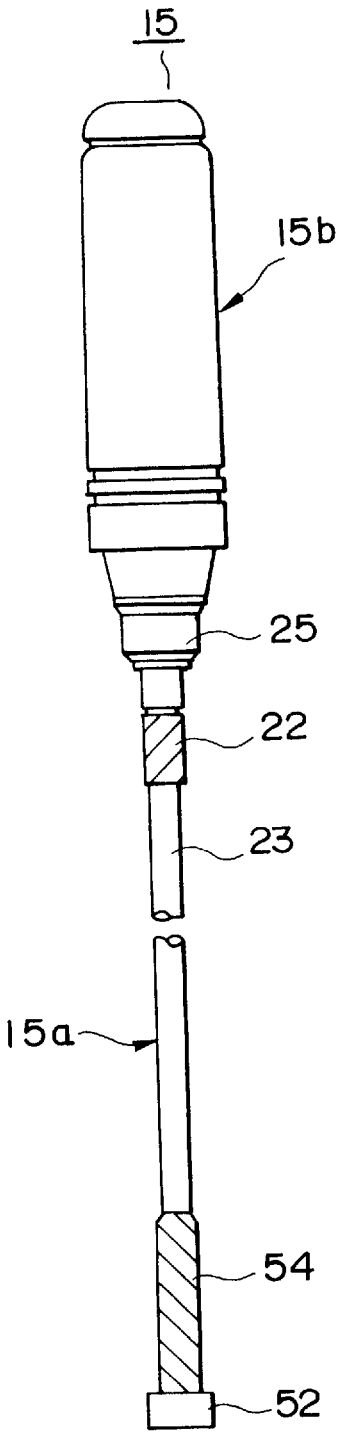
Figure 11B:
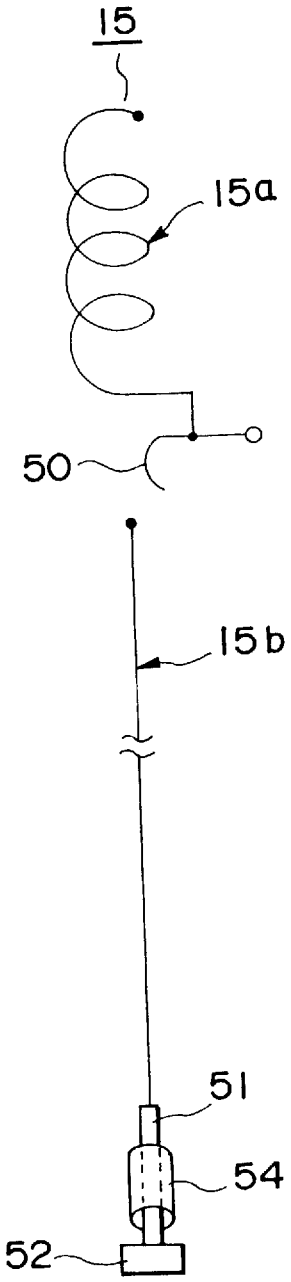

FIGS. 10A and 10B show the communication state where the L element 15*a* is in the extended state, while FIGS. 11A and 11B show the standby state where the L element 15*a* is in the retracted state. The L element 15*a* has a dielectric cylindrical member 54 fitted over the connection terminal 51. Accordingly, when the L element 15*a* is extended, the connecting terminal 50 comes in contact with the cylindrical member 54 so that a capacitor is formed. As should be appreciated, this capacitor works as the reactance element 16. On the other hand, when the L element 15*a* is in the retracted state, the cylindrical member 54 and the connecting terminal 50 get out of contact with each other so that the S element 15*b* functions. In this embodiment, the switching means 17 is constituted by the connecting terminal 50 and the connection terminal 51.

Figure 12:
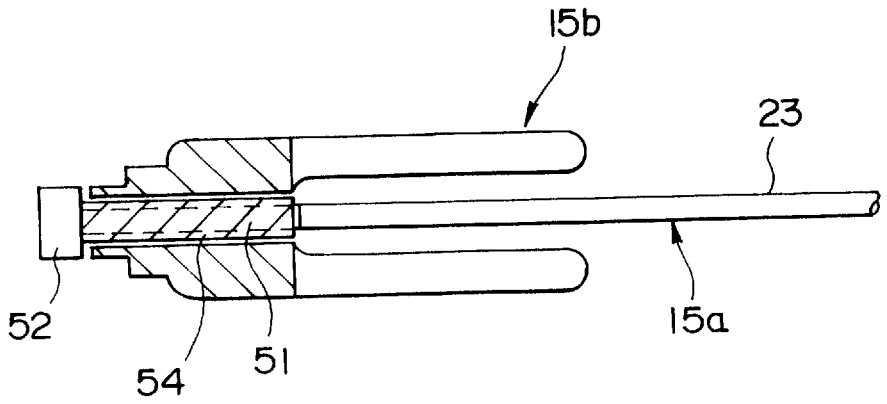
FIG. 12 is a partial sectional view of the antenna in the communication state shown in FIG. 10A.

FIG. 12 is a partial sectional view of the antenna in the communication state shown in FIG. 10A.

If a surface of the cylindrical member 54 is coated with a conductive material, such as, aluminum, phosphor bronze or stainless steel, a capacitor of a concentric structure is formed so as to achieve capacitive coupling with high efficiency.

Figure 13:
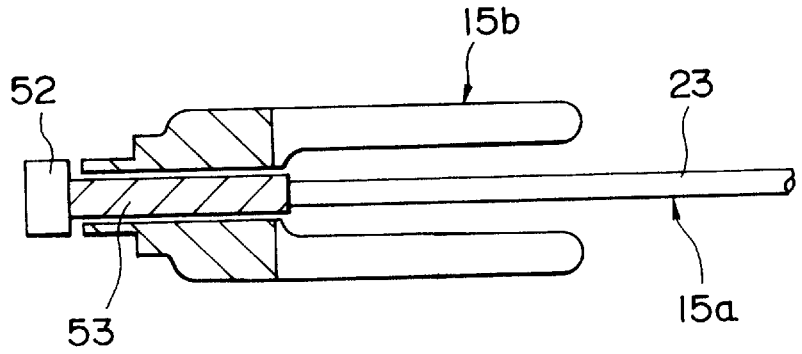
FIG. 13 is a partial sectional view of an antenna in a communication state according to a modification of FIG. 12.

A structure for capacitive coupling between the L element 15*a* and the matching circuit 14 is not limited to that shown in FIGS. 10A, 10B and 11A, 11B. For example, as shown in FIG. 13, the connection terminal 51 may be in the form of a connection terminal 53 of a dielectric and fixed to the conductive part 23 of the L element 15*a*. If the connection terminal 53 is formed of a magnetic body, such as a bead core, a highly inductive reactance element 16 can be achieved.

Figure 14A:
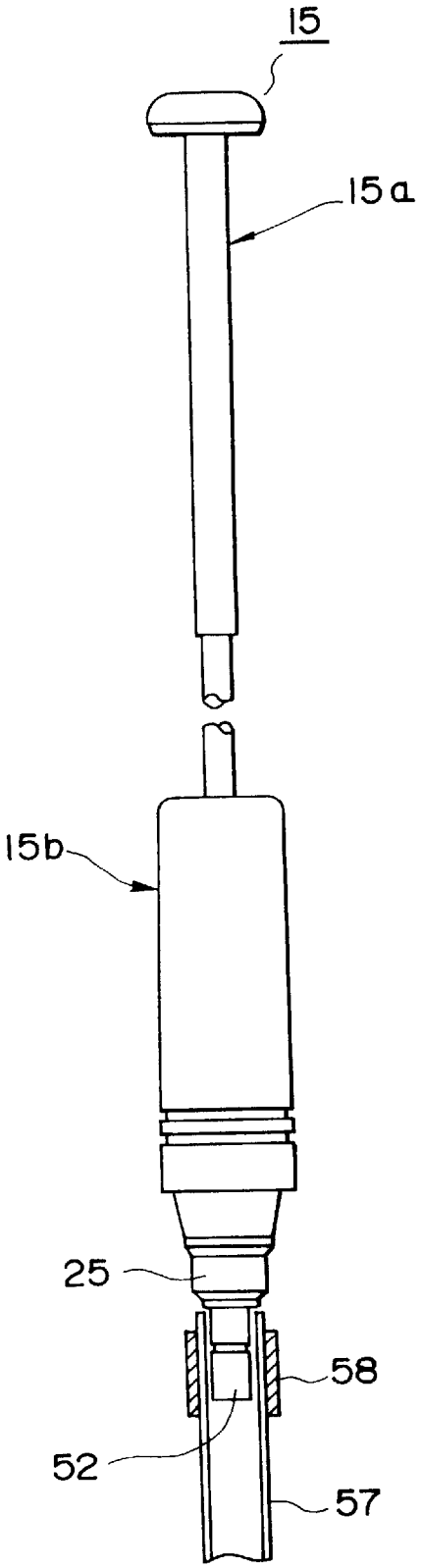
Figure 14B:
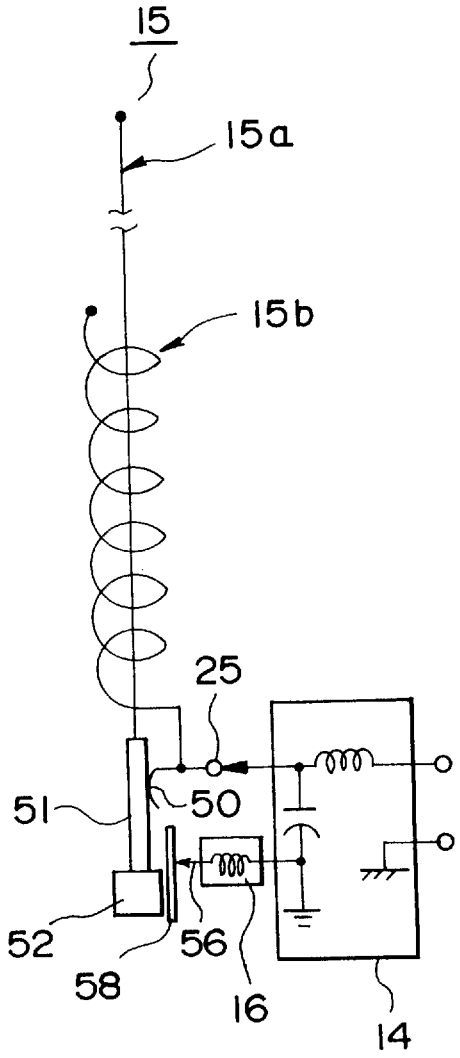

As shown in FIGS. 14A and 14B, it may be further arranged that an elongate dielectric tubular member 57 is fixed at an end portion of the S element 15*b* remote from its tip, that is, at a lower end, in the figures, of the S element 15*b*, and an electrode 58 is provided surrounding an upper end portion of the tubular member 57 so as to be in constant contact with the impedance matching means connection terminal 56 which is connected to the reactance element 16. The impedance matching means connection terminal 52 is movably retracted in the tubular member 57. In this embodiment, the switching means 17 is constituted by the connecting terminal 50, the connection terminal 51, the impedance matching means connecting terminal 56, the electrode 58 and the impedance matching means connection terminal 52.

With this arrangement, in the standby state where the L element 15*a* is in the retracted state, the impedance matching means connection terminal 52 is largely remote from the electrode 58. Since the reactance element 16 is connected to the electrode 58, a capacitor having the electrode 58 and the impedance matching means connection terminal 52 as counter electrodes is formed so as to provide capacitive coupling. However, since the capacitance is in inverse proportion to a distance between the counter electrodes, the capacitive coupling in the standby state is weak enough to be regarded as a disconnected state.

On the other hand, in the communication state where the L element 15*a* is in the extended state, the impedance matching means connection terminal 52 comes to a position corresponding to the electrode 58 so that a distance between the counter electrodes of the capacitor becomes minimum. Accordingly, the capacitor having the large capacitance is achieved so that the capacitive coupling between the L element 15*a* and the reactance element 16 becomes strong to achieve the impedance matching relative to the L element 15*a*.

Since the tubular member 57 also works as a guide for retracting the L element 15*a* therethrough, the retracting operation of the L element 15*a* is facilitated.

As described above, in the foregoing preferred embodiments, communication can be performed using the antenna which is matched in impedance on either transmission or reception of radio waves so that the power loss can be suppressed. Further, since the electric connection state can be switched in response to the extending/retracting operation of the movable element, an operation which would be otherwise required for switching the electric connection state can be omitted to improve handiness of the radio transceiver.

While the present invention has been described in terms of the preferred embodiments, the invention is not to be limited thereto, but can be embodied in various ways without departing from the principle of the invention as defined in the appended claims.

What is claimed is:

1.A mobile radio transceiver having an antenna which includes a fixed element and a movable element, the movable element arranged to function when the movable element is in an extended state, while the fixed element is arranged to function when the movable element is in a retracted state, said mobile radio transceiver comprising:

impedance matching means for matching antenna element impedance, the impedance matching means changing the impedance thereof depending on the extended or retracted state of the movable element, said impedance matching means matching impedance of the movable element when the movable element is in the extended state and matching impedance of the fixed element when the movable element is in the retracted state; and switching means for switching a connection state of said impedance matching means depending on the extended or retracted state of the movable element;

wherein said switching means comprises:

a first connection terminal, provided at an end portion of the fixed element remote from its tip, for inputting or outputting a radio-wave signal;

a second connection terminal, provided at an end portion of the movable element remote from its tip, said second connection terminal arranged to be in contact with said first connection terminal when the movable element is in the extended state;

a magnet, provided on the movable element near said second connection terminal; and a reed switch connected to said impedance matching means, said reed switch arranged to be operated by said magnet when said first connection terminal is in contact with said second connection terminal.

2. An antenna system for a radio transceiver comprising:

an extendible and retractable main antenna;

a fixed standby antenna;

matching circuitry which changes between an impedance to match the main antenna impedance to the radio transceiver when the main antenna is extended, and a respective different impedance to match the standby antenna to the radio transceiver when the main antenna is retracted; and a switching mechanism which selectively connects the matching circuitry to the main antenna or the fixed antenna, depending on whether the main antenna is extended or retracted, respectively, and causes the matching circuitry change between respective impedances depending on whether the main antenna is extended or retracted;

wherein the switching mechanism comprises:

a magnetic element disposed on the main antenna; and a magnetically activated switch coupled to the matching circuitry, which is activated when the main antenna is extended to thereby cause the change of impedance of the matching circuitry to match the impedance of main antenna.

3. The antenna system for a radio transceiver according to claim 2, wherein the switching mechanism comprises a plurality of terminals on the main antenna which are operatively connected with or disconnected from corresponding terminals of the matching circuitry depending on whether the main antenna is extended or retracted, respectively.

4. The antenna system for a radio transceiver according to 2, wherein the switching mechanism comprises:

a terminal on the main antenna;

a terminal on the matching circuitry; and a dielectric member disposed to be between the terminal on the main antenna and the terminal on the matching circuitry when the main antenna is extended, wherein a capacitive coupling is effected between the terminal on the main antenna and the terminal on the matching circuitry when the main antenna is extended.

* * * * *